United States Patent [19]

Rose

[11] Patent Number: 4,884,299

[45] Date of Patent: Dec. 5, 1989

[54] DISPOSABLE BIBS, PACKAGING AND AFFIXING TABS

[76] Inventor: Connie Rose, 1821 Alta Vista Dr., Vista, Calif. 92083

[21] Appl. No.: 709,775

[22] Filed: Mar. 8, 1985

[51] Int. Cl.[4] ..... A41B 13/10

[52] U.S. Cl. ..... 2/49 R; 2/243 R

[58] Field of Search ..... 2/49 A, 49 R, 243

[56] References Cited

U.S. PATENT DOCUMENTS

| | | | |
|---|---|---|---|
| 1,700,594 | 1/1929 | Pope et al. | 24/682 |
| 2,440,666 | 4/1948 | Miller | 2/49 R |
| 2,446,689 | 8/1948 | Brose et al. | 2/49 R |
| 2,633,396 | 3/1953 | Kawecki | 312/39 |
| 2,763,867 | 9/1956 | Chagnon | 2/49 R |
| 2,838,758 | 6/1958 | Townley | 2/49 R |
| 2,949,611 | 8/1960 | Wilkaitis | 2/49 R |
| 2,955,293 | 10/1960 | Peterson . | |
| 3,001,646 | 9/1961 | Cooper | 2/49 R |
| 3,032,773 | 5/1962 | Piazze | 2/49 R |
| 3,116,030 | 12/1963 | Leotta . | |
| 3,146,464 | 9/1964 | Burnett . | |
| 3,146,465 | 9/1964 | Hummel | 2/49 R |
| 3,160,361 | 12/1964 | Monahan . | |
| 3,229,875 | 1/1966 | Stoller . | |
| 3,233,248 | 2/1966 | Bushnell | 2/2 |
| 3,286,279 | 11/1966 | Brown . | |
| 3,329,969 | 7/1967 | Farber et al. | 2/49 R |
| 3,332,547 | 7/1967 | Rowe . | |
| 3,583,558 | 6/1971 | Davis | 2/49 R |
| 3,793,644 | 2/1974 | Kellner | 2/49 R |
| 3,916,447 | 11/1975 | Thompson | 2/49 R |
| 3,979,776 | 9/1976 | Gruenwald | 2/49 R |
| 3,995,321 | 12/1976 | Johnson . | |
| 3,999,221 | 12/1976 | Hannigan . | |
| 4,130,228 | 12/1978 | Perrin | 324/65 R |
| 4,233,688 | 11/1980 | Hjerl | 2/49 R |
| 4,261,057 | 4/1981 | Andersson | 2/49 R |
| 4,495,658 | 1/1985 | Moret et al. | 2/49 R |
| 4,523,333 | 6/1985 | Spangler . | |
| 4,543,668 | 10/1985 | Franklin . | |
| 4,601,065 | 7/1986 | Sigl et al. | 2/49 R |
| 4,649,572 | 3/1987 | Roessler | 2/49 R |

FOREIGN PATENT DOCUMENTS

| | | | |
|---|---|---|---|
| 1036330 | 9/1953 | France | 2/49 R |
| 0715557 | 9/1954 | United Kingdom | 2/49 R |
| 0905180 | 9/1962 | United Kingdom | 2/49 R |

*Primary Examiner*—Werner H. Schroeder
*Attorney, Agent, or Firm*—Lyon & Lyon

[57] ABSTRACT

This invention relates to a novel and workable concept for disposable baby bibs, related packaging, and unique tabs to affix said disposable bibs to infants or adults.

32 Claims, 7 Drawing Sheets

91
91
15
20
6
15
12
2
10
10
10
19
11
14
1
12
2
18
17
31
20
27
28
3
26
10
29
1
12
13
27
28
10
29
3
1
33
30
15
7
19
11
14
10
31
1

Fig. 5b
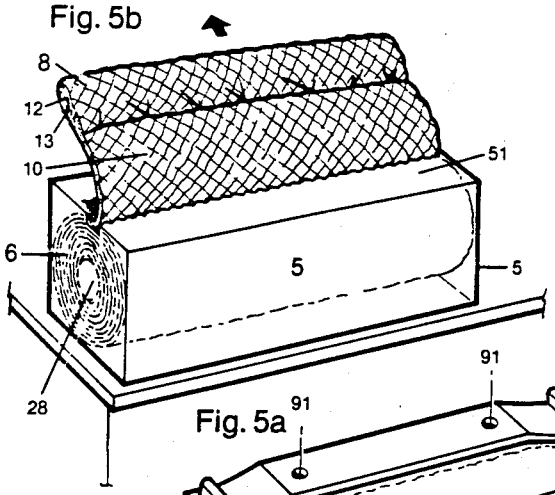
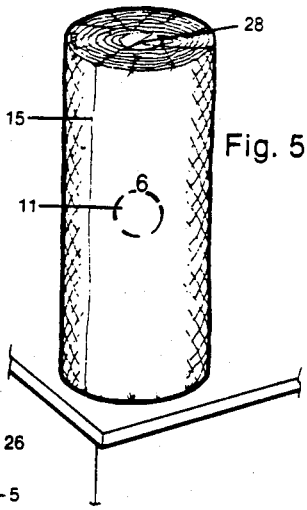
Fig. 5c
Fig. 5a
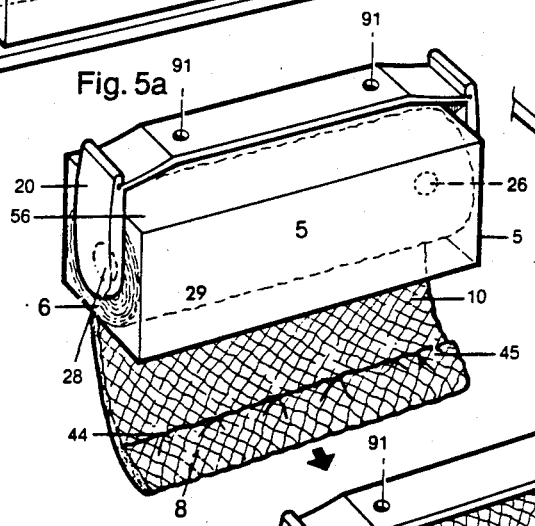
Fig. 4a
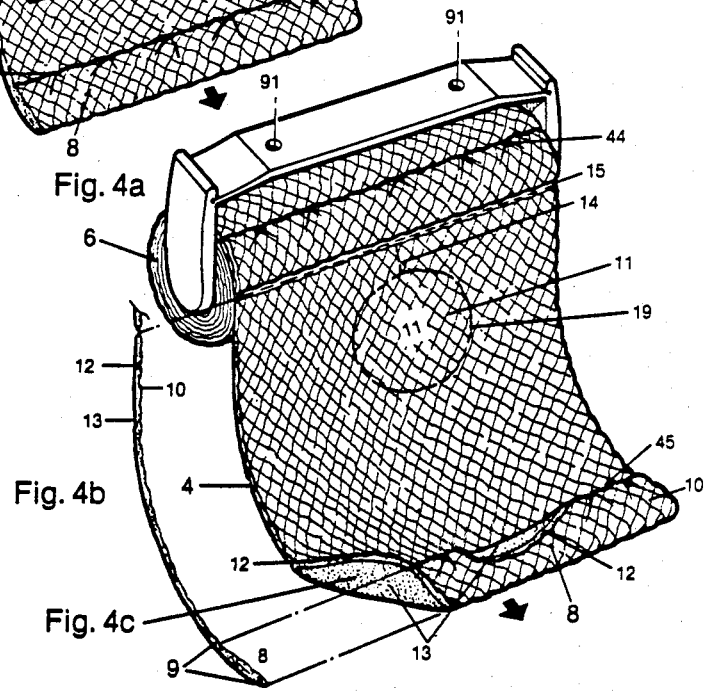
Fig. 4b
Fig. 4c Fig. 11a
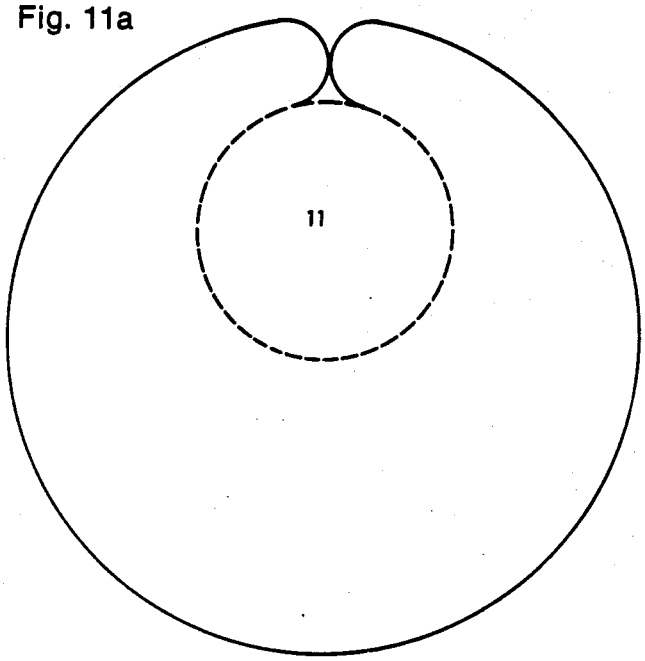
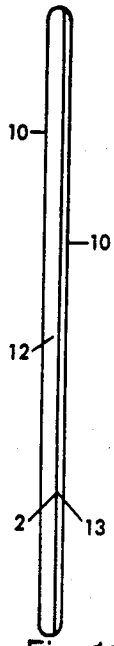
Fig. 11b
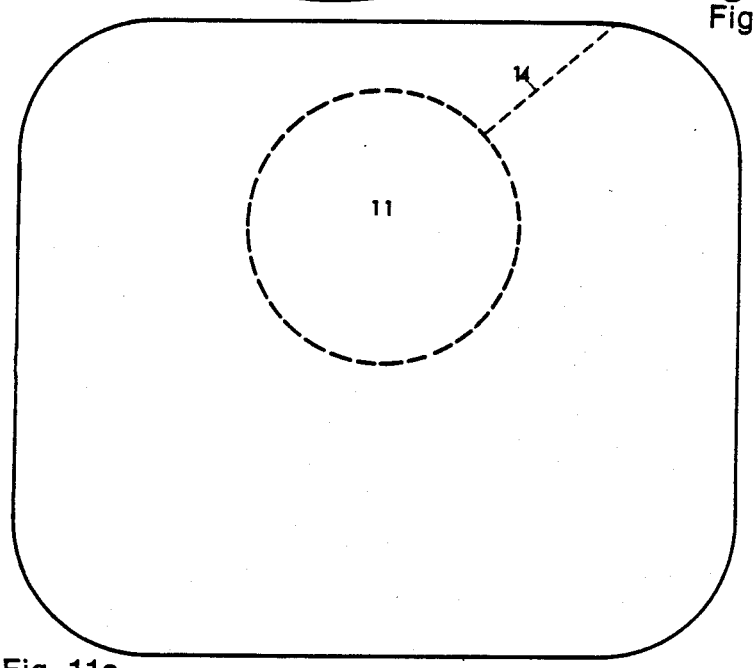
Fig. 11c 14
9b
11
8
2
13

10
12
13

DISPOSABLE BIBS, PACKAGING AND AFFIXING TABS

This is a continuation-in-part of co-pending application Ser. No. 576,003 filed on Feb. 2, 1984, now abandoned.

REFERENCES CITED

The following references are of record in the file of this patent.

| U.S. Pats. | | |
|---|---|---|
| No. | Name | Date |
| 3,001,646 | J. A. Cooper | September 26, 1961 |
| 3,146,464 | E. N. Burnett | September 1, 1964 |
| 3,540,060 | G. W. Brown | November 17, 1970 |
| 3,999,221 | Hannigan | December 28, 1976 |

BACKGROUND OF THE INVENTION

My research in the prior art revealed a variety of disposable bib inventions that have been issued patent numbers, but I find no similar or adequate products are available for the average home user in the supermarkets or other retail outlets. In reviewing the above patented concepts, I observed many weaknesses within the prior art relating to design, use, function and suggested dispersement. The bibs I studied within the prior art required too much folding, adapting, and attaching of pieces and tabs especially when a baby or child is "in the arms" or "screaming" to be fed. Although my patent search was completed through an attorney after I had designed my advanced and simple disposable bibs, the patents of J. A. Cooper, Sept. 26, 1961, 3,001,646; E. N. Burnett, Sept. 1, 1964, 3,146,464; G. W. Brown, Nov. 17, 1970, 3,540,060; Hannigan, Dec. 28, 1976, 3,999,221, all lacked in simplicity of use in that they required too much fastening, folding and adapting to make them practical. The pressed together and folded cup portions fail to contain any measure of food and especially liquids in that the adhesive that is pressed together will not stay sealed because the very liquid it is to contain softens the adhesive and the liquid oozes and spills out of the edges creating a bigger mess.

Paper shields per se do not have any measure of sufficient absorbancy, as they are more adequate for restaurants where the feeding situation is more controlled. In the prior art the affixing of the disposable bib is briefly mentioned with two tear strips which, when tugged, come apart. When an adhesive or velcro-type tab is used behind the neck (especially on a fussing child), the velcro and adhesive portions adhere to the infants' fine hair and skin causing frustration and irritation to the child and the one applying the bib.

The perforated neck opening, when placed directly behind the head, is awkward to get to and utilize. My discussion with other mothers revealed a desire for a disposable bib where the pre-cut or perforated neck access line similar to the 14 on my FIG. 1*a* is offset from behind the neck to the left or the right towards the side and front portions of the bib. The newborn and smaller child does not have the intelligence or ability to reach up and detach the bib, therefore it would seem a better idea to place the affixing tab over the left or right shoulder for ease of use. Once the child comprehends how they attach they do try to undo them and when they begin to coordinate sight with reach to undo them, I prefer shifting to my disposable bib that has an easy closure and sizing behind the neck, and a cup piece on the bottom portion to collect liquid and other bits and spills. With regard to sizing the neck, the prior art shows bibs that have several layers that can be removed or affixed to correct the neck size. Others have perforated strips of the same goods which when separated along the perforated edge form two fastening pieces to secure around the neck—more folding, and adapting. The center neck portion similar to 11 on FIG. 1*a* of my invention is often not retained for use in the prior art or is retained with a limited function due to the placement of the moisture-repellant layer and absorbant layers.

In the wording contained within prior patent applications the difficulties of packaging and dispensing are addressed but left unanswered, especially when manufacturing the disposable bibs on a core, solid or porous housing that would form a bulky or unsightly assembled form such as a roll, stack or layered bundle.

My disclosure will reveal to you efficient disposable bibs that will address all the above short-comings in that they will be simple in design and use for ease of placement and reuse if not soiled. These bibs will be cost efficient and easy to manufacture and distribute in a pleasant manner to mothers and others who are anxiously awaiting such a needed product. Further modifications and simple adaptions will further enhance the use for the growing child. The dispensing of the disposable bibs within the home will be facilitated by the use of versatile cost efficient dispensers that can be freely placed on a cabinet, dresser, floor or car. They are convenient to place in diaper bags for visits and sitters, attached to cabinets and other holders, or affixed to permanent holders. My innovative cover piece will easily adapt to a standard paper towel-like or custom dispenser. It will be simple and cost efficient to manufacture and versatile in its function in that it will give an additional reinforced edge to facilitate separating one bib from another while also acting as a cover piece over the assembled bib portions, should those bib portions appear bulky or unsightly to the user. The placement of my disposable bibs as they are attached and possibly reattached when not soiled will be facilitated by innovative tabs that I believe are some of the key factors in making my invention a desirable product for today's market.

I pray that further disclosure of my objectives and claims will make clear the uniqueness of my invention.

SUMMARY OF THE INVENTION

It is therefore the main objective of this invention and related species to provide disposable bibs, related packaging, and affixing tabs with improved structure and function. I propose to alleviate short-comings in the prior art by providing disposable bibs that are simple in design, function and utility. To achieve this, the first presentation is to have a favorable structure especially when used on the newborn to small infant.

The first objective is to utilize a disposable bib structure especially useful for the newborn or small infant. This can be made in one or a variety of sizes wherein a simple circular, oval, square or rectangular shape has an absorbant layer, a moisture-impervious layer, and an optional gauze-type decorative layer which allows spills to pass quickly beneath to more absorbancy and offers an optional decorative layer on the front or the front and the back.

The second objective is that the neck piece can be removed during manufacturing and sold as a separate product such as a coaster, wipe, or nursing pad; therefore offering a product that can generate additional sales. I prefer utilizing the neck piece by perforating a removal piece or cutting and including the neck piece as a separate portion to be utilized as a nursing pad immediately or at a later time in that nursing mothers will frequently have additional breast milk that is stimulated during the feeding time and leaks into the bra housing. The neck portion that has the soft gauze layer on the front and back portions creates a quiet, soft and absorbable insert for placement next to the skin and bra. The moisture-impervious layer can be placed within the absorbant layer to prohibit any seepage to the outer garments. By placing the tear edge similar to 15 sideways on a roll or sheeting during manufacturing especially on the size containing a potential nursing pad, wipe or coaster, this neck portion can be safely removed and sold separately without affecting the tear strength. This same neck piece when retained on the original bib housing can be used as a quiet plaything when at home or in a restaurant, and it's a handy wipe or coaster.

The third objective is to have a perforated or pre-cut neck access opening on the disposable bib that is placed preferably to the right or left of the back of the middle of the head, or over either shoulder for ease of handling and placement.

A further objective is to modify the original bib design by adding a pre-sealed or folding cup piece that does not leak. I prefer the pre-sealed cup pieces that are pre-sealed during manufacturing and require little to no handling by the user. The objective and advantage of this innovative cup or pocket-like portion can be attained by pre-sealing the bottom portion of the original bib housing by turning it up during manufacturing and sealing it to the sides of the original bib housing. As the child grows, the original bib can be modified and realigned to further accommodate the cup piece portion. A main objective of this cup and pocket-like structure is no handling is required by the user as in the prior art. Although such a cup piece may result in the awkward stacking, layering or rolled goods, that result can be made functional by a further objective of this patent—custom dispensers to disperse the regular or bulky bibs practically and efficiently.

Another objective it to have the capability of utilizing a cup or pocket-like piece of goods that instead of being turned, folded and sealed during manufacturing, it will be a separate piece of goods that can have the same or different layering and can be the same width or wider, and from one inch or larger in depth. This separate piece will be placed on top of the original bib housing and then sealed to the bottom and side edges. At least two advantages result in that the original bib housing can be placed on a continuous flow of goods and during manufacturing would not involve a lot of additional cost to include the cup piece. Also if a wider piece of goods than the original backing is attached to make the cup or pocket-like portion, the resulting cup piece will form a larger more efficient pocket. When this wider front cup piece is sealed at the bottom and sides of the base bib, and those bibs are sealed and stacked or rolled together, it will form a puckered cup portion usually at the top edge of the front cup piece. The cup or pocket-like piece can then be utilized on the bib by drawing the top portion out so that the spills and bits and pieces can drop and be contained and absorbed easier due to the larger holding space created.

A main objective with regard to the packaging is to provide functional and decorative dispersement of the disposable bibs. During manufacturing the bibs can be separated, stacked one by one in a bag or box, or layered in a bag or box, or contained in a box-like housing or a custom box-like housing with curved portions that adapt to the shape of the roll. These containers could have a decorative, plain or matching pattern to add a pleasant and unique display and function to any nursery, travel bags or other rooms. A square box-like container may be more cost efficient. It is my objective that both the square, box and other containers have a perforated or open end piece. The perforated end piece would remain intact and barely noticeable when placed on an open edge or counter, or the same container can easily have the perforations removed to reveal a core or piece that can be hung on a towel-like or fixed custom dispenser which allows the user to remove the disposable bibs from the front face, back, top or bottom with ease. Said dispenser could have a reinforced tear edge.

Another objective of this invention is to offer an innovative related cover piece that can be easily affixed to a dispenser. One easy adaption is a curved over piece that will easily adapt to existing paper towel-like holders or to new and innovative similar holders. It can be attached by utilizing existing or new screw holes by means of the same or longer screws, and if necessary washer-like or decorative metal, plastic, wood or paper-like spacers. When made with a rigid portion on at least one of the edges this adaptive piece can also be used as a reinforced or plain tear edge that will make it easier to separate one bib from another as in the case of continuously rolled goods. This would also allow the bibs to be sold in cost-efficient packaging, such as a plain bag, paper or plastic, and then placed behind or within the over portion to create a nicer aesthetic dispensing and optional tear edge.

A further option of this interrelated invention proposal is to disclose unique and functional sealing and possibly resealing tabs to affix said bibs to the infant or adult. Tabs are so important for ease of handling and I think that the prior has not revealed sufficient affixing pieces that are easy to use, non-toxic and safe, especially for the babies. Although the above bibs can be manufactured in a variety of shapes and sizes, it could also be produced with a variety of neck sizes available for purchase and not requiring sizing with the tab. I think a redeeming cost factor would be the tabs I have designed. They are designed to adjust to a wide range of neck sizes by the selective placement of the individual tabs. My related tabs will fasten in such a way as to size around the neck comfortably and snuggly so that there are no gaps that would allow liquids and bits or particles of food to get behind the neck edge and bib facing so as to soil the undergarments or skin.

It is my further objective with regard to the tabs to offer some tabs that are pre-sealed to the disposable bib, or other twist, clamp, button or snap-like pieces that could be included on each bib or sold separately or singularly in a bag, box or other dispenser housings. These could be reused on other disposable or other bibs. They would have the option of being used as a toy or collective set of toys to entertain the small infant or adult.

A further option for adult use would be a modification of the invention to include side flaps to be used or placed on handicapped children or adults or those bedridden or having limited use of hands and arms or in need of assisted feeding. This disposable bib version would be easy to use and could provide additional side coverage to protect clothing, bedding or gowns. A cheerful or pleasant pattern could add dignity and charm during limiting situations or in case the individual has difficulty retaining food, liquids, medicines and other substances within the stomach or body cavity.

In summary of these objectives, I have presented a new disposable bib concept that can be made in a variety of sizes and could be designated newborn, small, medium, large and extra-large. Although I prefer to selectively use the disposable bib presented in FIG. 1*a* for the newborn to small user due to the cupless nature and dual functioning neck piece, along with the side fastening option, this bib is structured so as to be able to be made in all shapes and sizes and is interchangeable as to the side openings or behind the neck openings presented in FIG. 4*a*. It is also interchangeable with respect to all packaging techniques displayed in this proposal, as well as all of the cup and pocket-like pieces, along with the neck portions and affixing tabs heretofore mentioned. The same applies to FIG. 4*a* and related modifications. The cupped version seems a better choice for the growing child but it is also purposely structured so as to be adaptable from the smallest to the largest size, and is interchangeable with respect to all the packaging techniques, cup portions and neck pieces and access portions, as well as the affixing tabs heretofore mentioned.

Other objectives and advantages of the invention disclosure will become more apparent from the following descriptions and drawings.

BRIEF DESCRIPTION OF THE DRAWINGS

FIG. 4*a* is a front elevation denoting the form and content of a cupped version of the disposable bib with multi-function neck piece, vertical placement on the sheet goods and dispersement on a standard roll or core-like dispenser.

FIG. 4*b* is a side perspective of the layering of the bib depicted in 4*a*.

FIG. 4*c* is a perspective view wherein the bib portion depicted in 4*a* has the left-front corner turned up to reveal a back perspective.

FIG. 5*a* is a perspective view of the dispensing of the bibs in FIG. 4*a* when a roll of the sheet goods is contained housed and protruding from a box-like housing contained on a paper towel-like holder.

FIG. 5*b* is a perspective view of a box-like structure housing and dispensing a roll of the disposable bib sheet goods wherein the perforated end pieces remain intact and the box-like housing is placed or affixed to a flat surface.

FIG. 5*c* is a plain roll of the sheet goods of disposable bibs secured around a core-like housing which can be placed freestanding on a counter, laid in a diaper bag, individually placed in boxes or covered with silicon-like material and sold as separate units.

FIG. 11*a* is a front view of the circular construction of the bib presented in FIG. 1*a* with curved overlapping or abutting neck access pieces.

FIG. 11*b* is a side view of the bibs portrayed in FIG. 11*a* and FIG. 11*c*.

FIG. 11*c* is a front view of the bib portrayed in FIG. 1*a* wherein it is constructed in a vertical position and portrays one of the positions for the neck access cut or perforation offset from the center back line.

DETAIL DESCRIPTION OF THE INVENTION

Figures 1A, 1B, 1C, 2A, 2B, 3A, 3B:
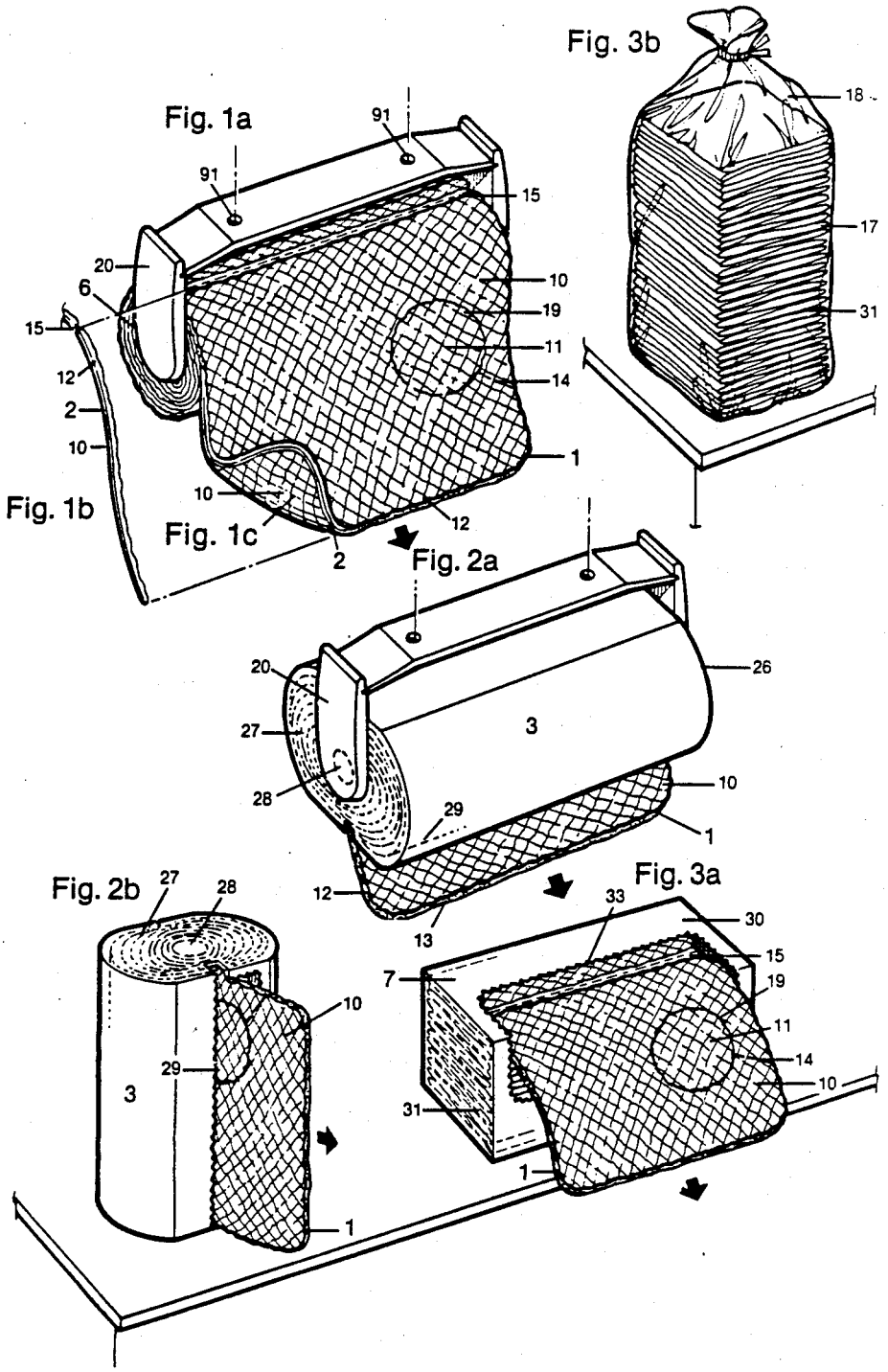
FIG. 1*a* is front elevation denoting the form and content of the cupless version of the disposable bib with multi-function neck piece, side placement on sheet goods and dispersement on a standard roll or core-type dispenser.
FIG. 1*b* depicts a side view of the various layers of the bib depicted in FIG. 1*a*.
FIG. 1*c* is an integral part of FIG. 1*a* wherein the front-left corner of the bib depicted has been turned up to reveal a back perspective.
FIG. 2*a* is a perspective view of the bib in FIG. 1*a* when housed in a curved dispensing structure and attached to a paper towel-like holder.
FIG. 2*b* is a perspective view of the disposable bib depicted in FIG. 1*a* when placed within a curved dispensing structure or placed freestanding on a flat surface.
FIG. 3*a* is a perspective view wherein a sheet of sectional disposable bib is layered as opposed to rolled within a box-like dispenser. The layering can be of individual bibs separated and stacked one above the other or of a continuous sheet that has a perforation line to detach one bib from another.
FIG. 3*b* is a perspective view of a bag-like housing wherein the disposable bibs are separated and stacked one by one within the housing or of having the bibs on a continuous sheet of goods and layering one above the other in the same housing.

Referring to the drawings, the cupless bib structure is designated in FIG. 1*a* as 1 and comprises a main body of suitable disposable material. The exterior layer 10 is an optional gauze layer that allows spills to pass directly to the absorbant layer 12 beneath and sealed within said absorbant layer is a moisture-impervious layer 2. Although the main body of the bib structure 1 is depicted sideways on a rolled sheet of goods 6, the strip that separates one bib from another 15 can be pre-cut during manufacturing allowing the individual bib structure shown to be sold as a separate unit 1. The neck access portion and resulting neck piece 11 can be perforated 14, or cut 19 to be separated from the main structure and sold or used as a separate product without interrupting the tear strength of line 15 which separates one bib from another as a whole unit. The neck portion 11, when removed, can then be used immediately or a later time as a soft functional nursing pad to be placed within a bra housing, or also used as a toy or wipe for the child, or a coaster or wipe on the counter structure, or other fixture. In FIG. 1*a* a sheet of the rolled goods is displayed on a paper towel-like housing 20 which can be attached to a fixed surface by means of access screw holes 91 on the proposed housing.

FIG. 1*b* shows a side view of the proposed layering of a cupless non-folding version of the disposable bib structure 1, wherein the gauze layer 10 is to the front and back exterior of the bib structure 10 wherein an absorbant layer 12 is a contained between the two gauze layers 10 and housed within said absorbant layer 12 is a moisture-impervious layer 2. The layer of absorbant material may be preferably chosen from the group of consisting of: cellulosic, paper, paper-like, plastic, and combinations thereof. FIG. 1*b* also depicts the gauze layer 10 as a plain as opposed to decorative or quilted portion that can be sealed as an integral part of the absorbant layer 12, or it can function as a plain or quilted portion. The absorbent layer 12 may be plain as opposed to quilted or the absorbent layer 12 may be embossed having a quilted, pocket-like structure as in FIG. 1*a* that overlays the absorbant portion. The perforated tear portion 15 can be perforated directly through the elongated section of sheet goods on the roll 6 or as depicted in this view at point 15, wherein the combining of the layers 10, 12 and 2 are condensed and sealed at the end of one unit of a bib 1 and then a thin connective layer continues and connects those bibs one to another with a perforated or separating line.

FIG. 1*c* is a back perspective of the bib structure wherein the soft quilted or plain patterned decorative gauze layer 10 is placed on the back and the moisture-impervious layer 2 is contained within the absorbant layer 12.

FIG. 2*a* is a perspective view of a custom curved dispensing structure 3 that can be made of plastic, paper or other material wherein the disposable bib is rolled in a circular fashion and placed loosely in the curved housing 3 that attaches to the paper towel-like holder 20 and then the custom dispenser 3 affixes between points 26 and 28 or the bib 1 can be rolled on a core, solid or porous structure which then suspends or contains that same structure between points 26 and 28 by having points 26 and 28 now representing perforated access portions that are removed and expose the core, solid or porous center of the rolled goods that now attach to the paper towel-like holder 20 between points 26 and 28. Protruding from the custom curved dispenser 3 at 29 is the cupless disposable bib housing 1 wherein the top layer is the gauze layer 10, the middle absorbant layer is 12 and the back layer is the moisture-impervious layer 2 or a light layer 13 as depicted in FIG. 4*a*.

FIG. 2*b* is the custom curved dispenser 3 made of paper, plastic or other material which by keeping the perforated core exposure piece 28 intact can be placed free-standing in an upright position or positioned horizontally on a flat surface allowing the rolled bib goods 1 with a gauze 10 or other layer, to be dispensed through an open portion 29 which at the point of opening can be serrated or reinforced to assist as a tear edge to separate one bib structure 1 from another at 15.

FIG. 3*a* is a box-like housing 30 made out of paper, plastic or other material wherein a section of disposable bibs can be slid into the end 7 of the box-like structure permanent or disposable housing 30 and dispensed in a layered fashion 31 utilizing the separating portion 15 to obtain one unit of the disposable bib 1 wherein 10 represents the gauze layer, 11 the neck piece, 14 the neck access cut on perforated line and 19 the neck piece perforation or cut-out line and 33 represents a cut, perforated, serrated or reinforced tear access slot wherein the portion that was removed to create the space within 33 can be removed for function or decoration, or can be retained in place when manufactured or sold to offer protection and to keep the bibs 1 sterile. An overlay of light clear or plastic-like material completely around the box 30 or just over the exterior space of 33 would create a sanitary cover for the bibs 1 and could provide a surface for the placement of the product name and other pertinent information thus leaving the box-like structure free to be designed in a plain or color-coordinated pattern for a decorative housing and dispenser for counter or nursery.

FIG. 4*a* is a perspective view of the innovative bib 1 wherein the cupless version is layered vertically on a sheet of goods and lengthened to a more rectangular shape 4*a*. A cup or pocket-like piece 8 is pre-sealed 9 at the side and bottom edges requiring no folding or handling by the affixer or user. Since no adhesive layers need to be exposed and fastened together the sealed edges create a virtually leak-proof seal.

An additional sheet of the base bib structure 4 may be cut the same width as the base portion or wider to form 8 the cup or pocket-like piece which is then pre-sealed at the sides 9 and bottom. When a wider section of 8 is presealed to the base 4, it forms puckers 44 when rolled, stacked or layered on or within a housing or core-like structure. The puckering 44 is convenient in that the added width of goods that creates the puckering can easily be drawn out when the bib is put to use and the pocket created will be larger, more accessible and more absorbant to collect bits and spills. When the moisture-impervious layer 13 is located on the back of the cup-piece width 8 and that cup-piece 8 is pre-sealed to the base 4, an additional innovative layering results in that the bits and pieces of food and the liquid that drops and is contained is forced back through the gauze 10 layer and, directly into the base 4 absorbant layer while still maintaining a pleasant non-folding or adapting decorative layer 10 on the front of the cup or pocket-like portion also. The vertical placement of the disposable bib 4 with the innovative pre-sealed cup 8 is advantageous to structuring the sheet of disposable bib goods on a circular roll, 6 layered 31 or singular 17 packaging. Side placement would not be cost advantageous and the bulkiness resulting on one or the other sides of the roll would be awkward and prohibitive. The layering of the said goods can even out the bulky segments, and when stacked one above another or alternate layering of the cup piece to the front and then to the back will offset the bulk that would result if the bib cup pieces 8 were stacked one on another. As mentioned earlier in the specification, the neck access cut or perforated strip can be returned to placement directly behind the neck in that the pre-sealed cup piece will offset the folded bibs and cupped portions in the prior art. When coupled with non-adhesive, 6*a* and 6*b* non-velcro 7*a* and 7*b* tabs the neck access piece when coupled with affixing tabs at the neck access line 14 that are non-adhesive can again be placed directly behind the head because those tabs will not stick to the hair or skin. It should be placed behind the head and out of sight and reach of the older child who will most definitely try to undo it if he or she spots it. The neck portion 11 can still function as a nursing pad to be used immediately or sold as a separate product. The cut or perforated neck piece 11, and access line 19 should remain somewhat attached and in place to give added form and strength to the manufacturing of the sheet goods and also some reinforcement for the separating line when placed on a roll or layered together. When this bib is sold as a separate unit stacked or placed one above the other and dispensed individually one at a time, it wouldn't matter if the neck piece 11 is removed and sold as another viable product. The paper towel-like holder can be affixed to a solid surface by attaching at points 91.

FIG. 5*a* is a perspective view of the bibs depicted in FIG. 4*a* when those bibs are placed on a roll 6 and dispensed from a permanent or paper decorative box 5 which would give additional coverage for the resulting bulky roll 6 and also give a serrated 29 or reinforced 29 edge to assist in separating one bib 4 from another 4. The mating of the roll housing to the paper towel-like holder 20 is depicted at 28 wherein the roll (6 on a core-like housing) can be slid into the box 5 from either side and suspended between points 28 and 26. Number 5*b* denotes the top portion of the box-like housing and that housing can be positioned to the back so that the rolled bib goods can be dispensed from the front or the bottom of the custom dispenser 5. The protruding bib unit depicts 10 as the exterior overlay gauze, but a patterned or printed absorbant layer could be represented as well. The cup or pocket-like piece 8 remains the same with 44 denoting the puckered sections and 45 depicting the space that is created behind the pocket 8.

FIG. 5*b* is the box-like housing that is made of permanent decorative paper wherein the roll 6 can be slid into the permanent dispensing structure and dispensed through the now resulting top edge labeled 51 or wherein the perforated end tabs 28 remain in place and a decorative paper-like box housing is laid horizontally on a flat surface. The bib 1 displayed protruding from this housing 5 is of the optional design wherein the moisture-impervious layer 13 is layered within the absorbant layer 12 allowing a single unit to be folded and presealed to form a cup or pocket-like piece 8 that is sealed at the bottom and sides of a vertical bib unit. The gauze layer that is folded inside absorbs more spills and the moisture-impervious layer 13 keeps the seepage from going forward through the cup piece 8 or back through the main bib structure 1 on to the skin or garments.

FIG. 5*c* depicts a singular roll of the disposable bib units 1 and 4 as depicted in FIG. 4*a* or FIG. 1*a*, on a core-like housing. Several rolled units can be placed side by side and sold in a bag or box or each roll 6 can be wrapped with paper, clear or plastic silicon material or other suitable wrap to keep said goods clean and sanitary and provides a good surface for the disclosure of the product name, and other pertinent manufacturing and other information, without having to affect the roll 6.

Figure 6A:
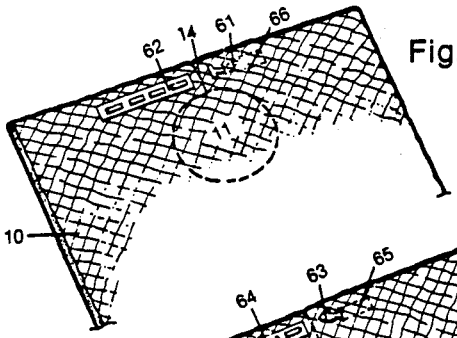
FIG. 6*a* is a perspective view of the upper portion of the disposable bib displaying a slotted T-type mated affixing tabs.

FIG. 6*a* depicts the upper portion of the bib embodiment 1 or 4 wherein the neck access line 14 is depicted directly behind the neck piece 11, and it can also be placed to the right or left of that line as depicted as 14 in FIG. 1*a* and still utilize very effectively the same affixing tabs wherein a T-type 61 plastic or reinforced paper portion is sealed on top 66 or within 65 the bib garment on one side (or the other) of the neck access line and the slotted adjustable mating portion is sealed at one end of the tab 62 allowing the end of the mating tab 62 closest to the access line 14 to be lifted and to receive the T-shaped mating tab into one of the slotted portions depending on the neck size of the infant.

Figure 6B:
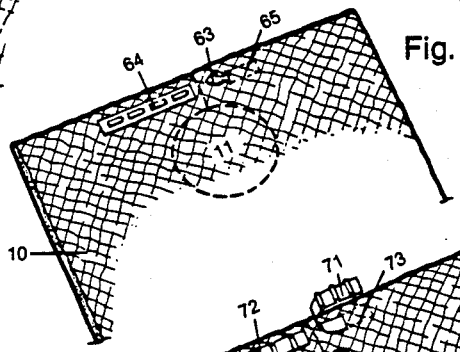
FIG. 6*b*is a modified view of FIG. 6*a* using slotted arrow-type mated tabs.

FIG. 6*b* is a modification of 6*a* wherein the slotted portion 64 receives the arrow-shaped mating tab 63 which is presealed at point 65.

Figure 7A:
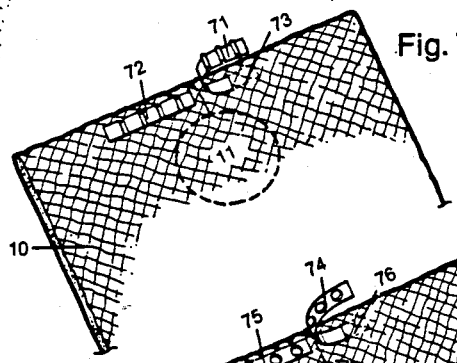
FIG. 7*a* is a perspective view of the upper portion of the disposable bibs using a pressed-together zip-lock-type vertical adjustable mating tabs.

FIG. 7*a* is a modification of the information disclosed in 6*a* and 6*b* wherein the mating tab 72 receives a zip-like or press-together type strip 71 which interlocks vertically with the mating piece and is hard to separate when tugged at due to the vertical placement. The mating tab 71 affixes to the bib structure at the end of the tab 73 leaving the front portion free to lift up and adjust to the most appropriate sizing link on 72.

Figure 7B:
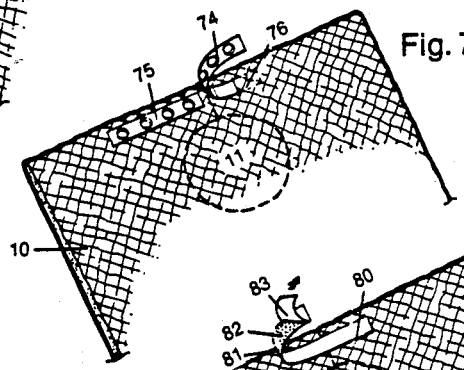
FIG. 7*b* is a modified view of FIG. 7*a* using circular-type snap-together tab or pressed-together zip-lock-type vertical adjustable mating tabs.

FIG. 7*b* is a modification of the above affixing tabs wherein the first mating tab 74 will snap together when aligned with the affixed tab 75 on the opposite neck access piece, said tabs 74 and 75 can also press together in a zip-lock fashion as well as interlocking in a snap-together manner.

Figure 8A:
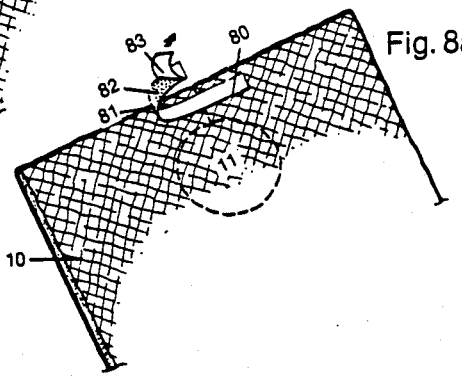
FIG. 8*a* is a perspective view of the upper portion of the disposable bibs having an elongated overlapping type tab affixed to the right or left of the neck, or overlapping both portions.

FIG. 8*a* is a somewhat different tab in that it is an elongated strip of paper-like material which can be elongated from points 80 to 82. Said tab 80 will affix to one side of the neck access line and then it will overlap the neck access line and after sizing the neck hole around the user the adhering portion of the tab will be pressed down. The adhesive can be permanent, resealable, or velcro-like and it will be exposed for usage by lifting the cover tab portion 83. Some advantages of this tab are that during manufacturing only one tab edge is affixed to either one side or the other of the neck access line. These strips are cost efficient and easy to use in that the non-adhesive portion between 80 and 82 can be left plain or coated with a soft material so that they will not adhere or irritate the skin or hair in case the neck opening line must be left somewhat open for sizing. This tab gives great flexibility in that in can easily "size" a variety of neck sizes by opening up, abutting or overlapping the neck access line. Again that neck access line can be placed directly behind the head, especially for older children or offset to one side or the other for ease of handling.

Figure 9A:
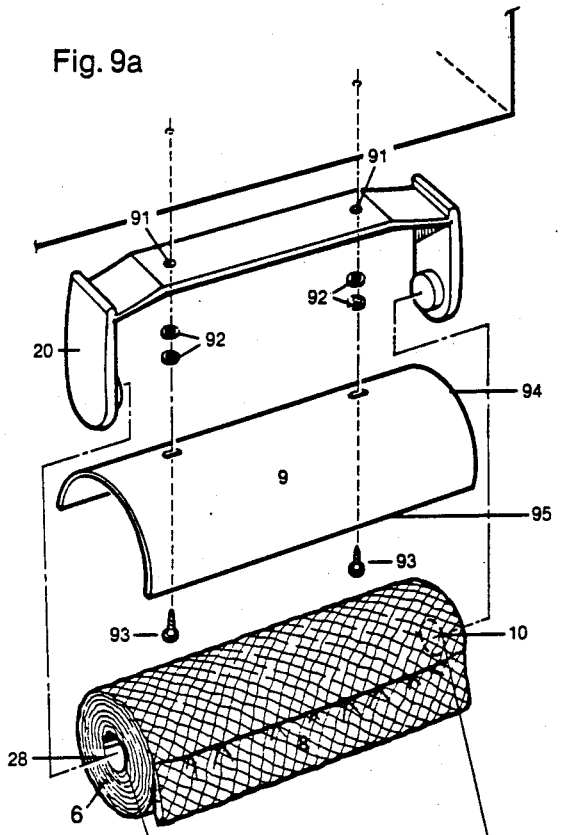
FIG. 9*a* is a perspective view of a curved cover portion that can be adapted or made a permanent part of a towel holder creating a functional and decorative cover for a regular flat or bulky roll or sheet of disposable baby bibs.

FIG. 9*a* depicts a new and innovative paper towel-like portion 9, that can be made of reinforced paper, metal, plastic or other silicon material. The curved shape of 9 gives a decorative cover piece for a rolled sheet of goods or disposable bibs and especially the "bulky" roll created when bib 4—the cupped version is rolled on a core-like base or housing. The cover piece 9 can be created color-compatible, or color-coordinated to match the design it covers. By having this cover piece 9 as an option the product could be sold in cost-efficient single or multi-pack rolls covered with clear plastic or other material.

The front bottom edge 95 of the cover piece provides an additional reinforced edge to facilitate the separation of one bib or other product from another, especially when a baby is "in arms". This cover piece 9 can also adapt to a standard or larger custom paper towel-like holder 20 by means of screws 93 that protrude up through the aligning holes that attach to points aligning with 91, and then this unit can be attached to a wall counter or cabinet or other flat surface. Plain washer-like or decorative spacer pieces can be supplied to affix the cover piece 9 to a variety of different holders 20. The adaptive holes can be aligned at any point along the cover piece so as to adapt to existing or different custom holders. This innovative cover is excellent for the disposable bibs but it can have the capability of being finished or even wall-papered to match the existing decor. The individual roll of goods 6 can then be affixed to the paper towel-like holder 20 as is depicted wherein the core-like center housing of the roll affixes the end access core holes 28. The disposable bib structure depicted is similar to FIG. 4*a* with a folded and pre-sealed cupped portion 8 or wherein a separate sheet of the same goods is overlayed and pre-sealed to the originating main bib body portion, wherein a cup portion is cut or retrieved from the top sheet of goods and then set in place and pre-sealed to the bottom portion forming the cup or pocket-like segment 8.

Figure 9B:
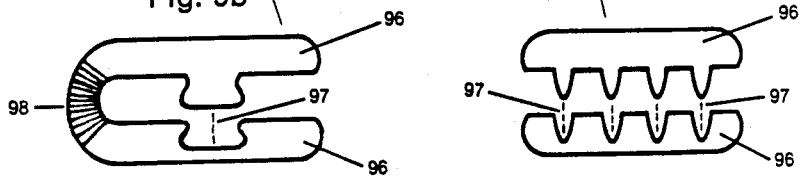

FIG. 9*b* shows an affixing tab 96 that can be sold by laying or securing in the core hole cutouts, and then wrapping with plastic or other paper or other silicon-like material. The tab 96 can have two mating pieces that snap or affix together through pre-cut holes on the neck access line, or it can be made strong enough to adhere both neck access pieces between the snap-together portions at point 97. This tab can have both portions hooked together 98 and have two a roll—one in each end hole, or it can have one portion of the affixing tab in each end hole and they can be removed and mated together. This would save cost by not having to preseal or attach and affixing portions to the bib, or bib rolled goods, and one or more new portions would come on the end of each roll with the potential of creating safe, non-toxic, playful pieces that can be reused again and again.

Figure 10A:
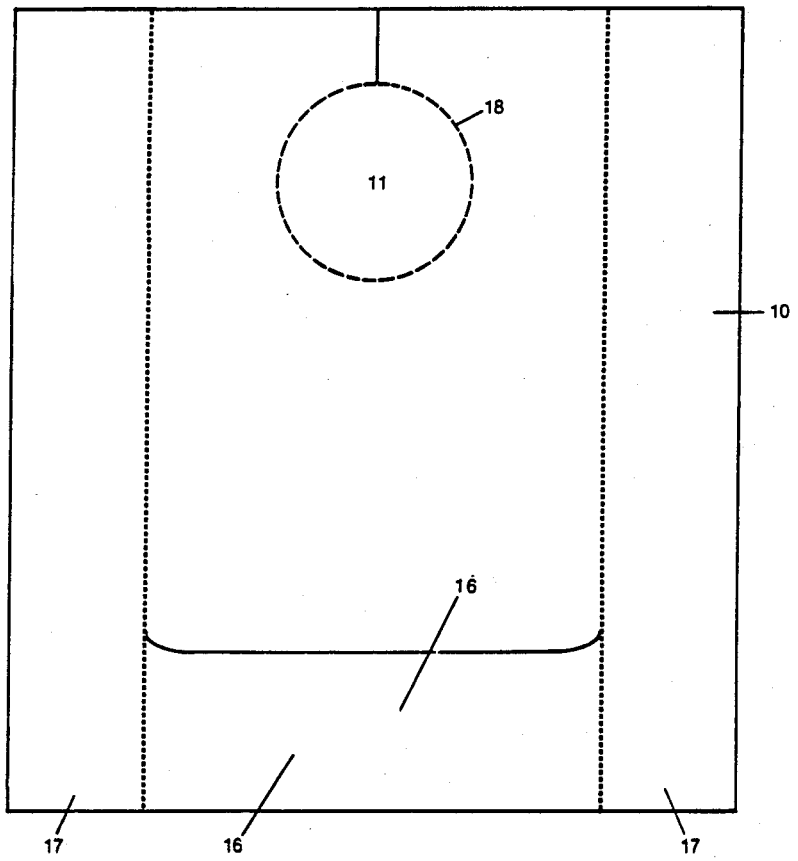
FIG. 10*a* is a modification of the bib structure wherein two additional side flaps are attached.
Figure 10B:
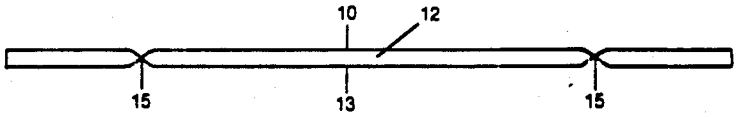
FIG. 10*b* is a side view of the layering of the components as structured in view FIG. 10*a*.

FIG. 10*a* is a modification of the bib depicted in FIG. 4*a* wherein additional side flaps 17 remain as an integral part of the bib to give increased side coverage especially for the gowns, garments and/or bedding of larger or incapacitated children or adults. The cup or pocket-like piece 16 depicted in this modification can have the moisture-impervious layer 13 sealed within the absorbant layer or structured to the back as depicted in FIG. 10*b*. The pocket-like cup does not need to extend over the flaps although it could be an option.

FIG. 10*b* is a side perspective of 10*a* wherein 15 denotes a perforated-type alignment for the side flaps 17 to attach to the main bib portion but due to the decreased layering at that point they can bend and adapt to lay over the user. The top layer 10 can be an overlay of decorative gauze, or a gauze layer 10 sealed as an integral part of the absorbant layer 12. Again the moisture-impervious layer can be placed on the back portion as shown or have the option of being layered within the absorbant layer as depicted in FIG. 1*a*.

FIG. 11*a* is a frontal view of a circular version of the bibs depicted in FIG. 1*a*–1, or FIG. 4*a*–4. This design allows for a uniform placement within a bag, box-like dispenser, or stacked in a box-like structure for singular dispersement.

FIG. 11*b* depicts a side perspective wherein the moisture-impervious layer is housed three-fourths of the way through the absorbant layer towards the back edge, and this same layering can be with the decorative gauze over or sealed within a part of the absorbant material.

FIG. 11*c* depicts a frontal view of the square-like bib disclosed and depicted in FIG. 1*a* wherein the neck access line can be cut or perforated to the right or left of a vertical line behind the head from the center of the neck piece outward and upward to the top bib head edge directly behind the head of the user.

Figures 12A, 12B, 12C, 12D:
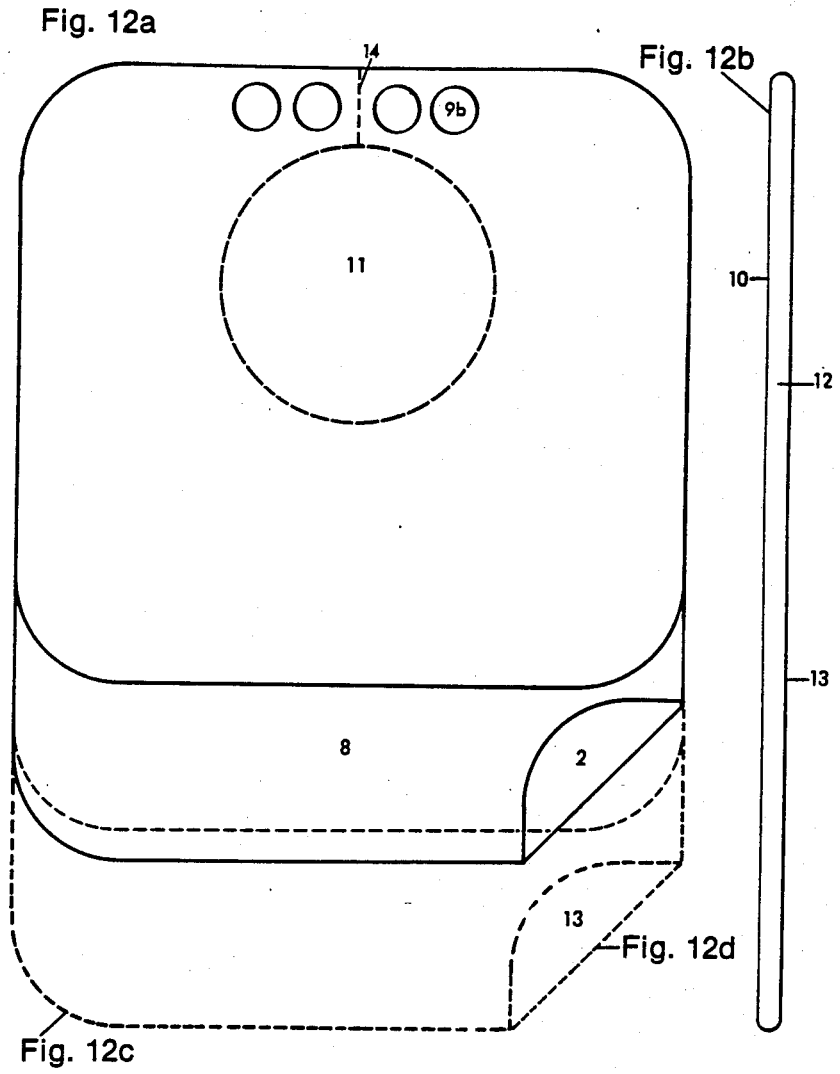
FIG. 12*a* is a front view of the basic bib structure with the neck access line centered behind the circular neck portion, and also depicts the cup piece modification and placement.
FIG. 12*b* is a side view of the structuring of the above bibs when the impervious layer is eliminated or placed on the back side of the above bibs.
FIG. 12*c* represented by the dotted lines shows a modification of the bib depicted in FIG. 12*a* or FIG. 11*a*, resulting in a larger size with more coverage and absorbancy.
FIG. 12*d* denotes a back view in that the corner is turned up to depict the back placement of the absorbant, moisture-impervious or optional gauze layer.

FIG. 12*a* is a frontal view modification of FIG. 11*a* wherein the square-like bib structure presented in FIG. 1*a* is elongated down each side edge so as to create more material on the main bib body portion on which to preseal or fold up a cup or pocket-like portion. Pre-cut tabs can accept the 9*b* tabs.

FIG. 12*b* is a side perspective view of 12*a* wherein there is just a gauze layer plain, printed or quilted to form a cupless disposable bib without attaching or folding pieces save the opening of the cut or perforated neck access line. The elongated cupped versions depicted could have a moisture-impervious layer 2 or 13, as depicted in FIG. 12*d*, a turned-up variation of the cupless or cupped bib structure. Wherein 12*c* represented by the dotted lines shows the modification of lengthening the main body bib portions resulting in a longer larger version capable of more coverage and having all of the structure options disclosed above.

In summary, my new disposable bib designs are structured to enable the user to utilize a more disposable bib that is easier to use in that there is no need to assemble, tear or affix numerous parts or pieces and the products have more absorbancy, especially the one structured with the pre-sealed cup portion. Containing the moisture-impervious layer within the structure of the bib aids in function, softness and decoration as well as providing a neck hole portion that can be sold as a secondary product or used immediately as a nursing pad, wipe, toy or coaster and the dispensing of the aforementioned bibs is facilitated by the unique containment within the custom dispensers—bags, boxes, rolls and others. The tab structures are quick and easy to use, they can be sized and most can be reused if the disposable bib is not soiled.

Further objectives and advantages of my improved disposable bibs, bib dispensers and bib tabs will be easy to distinguish when reviewing the above descriptions and following claims. While various changes may be made in the detail construction, it shall be understood that such changes shall be within the spirit and scope of the present invention and related disclosures defined by the appended claims.

What I claim as new and desire to protect with patent letters is:

1. A disposable bib comprising: a main body having two side edges, a top portion with a top edge, and a bottom portion with a bottom edge and having a series of layers comprising:

(1) a main layer of absorbant material, (2) a central layer of moisture-impervious material housed within said absorbant main layer, and (3) a front layer of a gauze-like material on the front of said main layer, the front layer sealed as an integral part of said main layer.

2. A disposable bib according to claim 1 wherein said neck access slot is comprised of a line of perforation extending from an edge of said neck cutout to the top edge of said main body, said line of perforation allowing detachment to permit placing said bib around a wearer's neck.

3. A disposable bib according to claim 1 further comprising a back layer of gauze-like material.

4. A disposable bib according to claim 1 wherein said gauze-like front layer is sealably attached to said absorbant main layer.

5. A disposable bib according to claim 1 wherein said main body is generally of a circular shape.

6. A disposable bib according to claim 1 wherein said main body is generally of an oval shape.

7. A disposable bib according to claim 1 wherein said main body is generally of a rectangular shape.

8. A disposable bib according to claim 1 wherein said bib is contained in a continuous sheet of a plurality of bibs, said bibs being detachably connected end to end by a thin connective layer.

9. A disposable bib according to claim 1 wherein the absorbant material is chosen from the group consisting of: cellulosic, paper, paper-like, plastic-like, and combinations thereof.

10. A disposable bib according to claim 1 wherein said main body has a neck cutout in the top portion of said main body, said bib further comprising:

a neck access slot in said main body angularly extending from said neck cutout to the top edge of said main body such that when said bib is worn, said neck access slot is over toward a wearer's shoulder rather than directly behind the wearer's head.

11. A disposable bib according to claim 1 wherein said main body has a neck cutout in the top portion of said main body and within said neck cutout is a neck cutout piece which is detachably connected within said main body.

12. A disposable bib according to claim 11 further comprising perforations between said neck cutout piece and said main body to permit easy removal.

13. A disposable bib according to claim 1 wherein said main body further comprises a cup-like bottom piece presealed at the bottom and sides of said main body for catching falling food pieces.

14. A disposable bib according to claim 13 wherein said bottom piece comprises a moisture-impervious back layer on the inside of said cup-like bottom piece.

15. A disposable bib according to claim 13 wherein said cup-like bottom piece is wider than the bottom portion of said main body causing the bottom piece to pucker and extend outwardly during use creating a large catching area.

16. A disposable bib according to claim 1 wherein the bottom edge of said main body is folded up and presealed at the side edges to form a cup.

17. A disposable bib according to claim 16 wherein said bottom portion which is folded up is wider than said main body causing said cup to pucker and extend outwardly during use.

18. A continuous sheet of disposable bibs comprising a series of bibs detachably connected end to end, each of said bibs comprising:

a main body having two side edges, a top portion with a top edge, and a bottom portion with a bottom edge and having a series of layers comprising:

(1) a main layer of absorbant material, and (2) a center layer of moisture-impervious material housed within said absorbant main layer; wherein the center layer of said bibs continuously extends between said bibs, said center layer being separable between each of said bibs to permit detaching, wherein said main body has a neck cutout in the top portion of said main body, and wherein said main layer is discontinued between consecutive bibs.

19. A continuous sheet of disposable bibs according to claim 18 wherein each of said bibs further comprises: a neck access slot in said main body angularly extending from said neck cutout to the top edge of said main body such that when said bib is worn, said neck access slot is over toward a wearer's shoulder rather than directly behind the wearer's head.

20. A continuous sheet of disposable bibs according to claim 18 wherein said bibs are detachably connected at the side edges thereof.

21. A disposable bib comprising (1) a main body having two side edges, a top portion with a top edge, a bottom portion with a bottom edge, said main body having a neck cutout in the top portion and a series of layers including a moisture-impervious layer and a layer of absorbant material, and (2) a cup-like bottom piece presealed near the bottom and sides of said main body, wherein said cup-like bottom piece comprises a piece separate from said main body including a moisture-impervious layer which is overlayed onto said main body.

22. A disposable bib according to claim 21 wherein said cup-like bottom piece is wider than said main body causing the cup-like bottom piece to pucker and extend outward during use creating a larger catching area.

23. A disposable bib according to claim 21 wherein said cup-like bottom piece further includes a front layer wherein the moisture-impervious layer of said cup-like bottom piece is adjacent said main body.

24. A disposable bib according to claim 21 wherein the layer of absorbant material is chosen from the group consisting of: cellulosic, paper, paper-like, plastic-like, and combinations thereof.

25. A disposable bib according to claim 21 wherein said separate piece of said cup-like bottom piece consists of a layer of moisture impervious material having an inner moisture impervious side facing said main body and a decorative side.

26. A disposable bib according to claim 21 wherein said layer of absorbant material is embossed.

27. A disposable bib according to claim 21 wherein said bib is contained in a continous sheet of a plurality of bibs, said bibs being detachably connected.

28. A continuous sheet of bibs comprising a series of bibs detachably connected consecutively one after each other, each of said bibs comprising a first layer of moisture-impervious material and a second layer of absorbant material attached to the first layer, wherein the first layer continuously extends between bibs and the second layer is separated by a space between adjacent bibs.

29. The continuous sheet of bibs of claim 28 wherein each of said bibs further comprises a separate cup-like bottom piece overlayed and presealed at a bottom portion of said bib.

30. A method of manufacturing a continuous sheet of bibs comprising:

forming a continuous sheet of moisture-impervious material;

perforating the sheet of moisture-impervious material to form bib body sections of desired size; and applying a layer of absorbant material to one side of the continuous sheet of moisture-impervious material such that absorbant material does not cover an area for perforation between the bib body sections.

31. The method of claim 30 further comprising forming a cup portion on one end of each bib body section by placing a section of bib material on the one end of each bib body section, pre-sealing the section of bib material to the outside edge and the side edges of the bib body section 32. The method of claim 31 wherein the cup portion is formed adjacent the perforation.

* * * * *

UNITED STATES PATENT AND TRADEMARK OFFICE

CERTIFICATE OF CORRECTION

PATENT NO. : 4,884,299

DATED : December 5, 1989

INVENTOR(S) : Connie Rose

It is certified that error appears in the above-identified patent and that said Letters Patent is hereby corrected as shown below:

On the title page, insert :

--Related U.S. Application Data
This is a continuation-in-part of co-pending application serial no. 576,003 filed Feb. 2, 1984, now abandoned.--

In Claim 2, line 1 thereof (column 6, line 6) delete "1" and insert -- 10 -- therefore.

Signed and Sealed this

Twenty-sixth Day of June, 1990

*Attest:*

*Attesting Officer*

HARRY F. MANBECK, JR.

*Commissioner of Patents and Trademarks*